United States Patent [19]

Faltus

[11] Patent Number: 4,461,424

[45] Date of Patent: Jul. 24, 1984

[54] NOZZLE AND GUARD UNIT

[76] Inventor: Arthur V. Faltus, 1643 LaSalle St., Belleville, Ill. 62221

[21] Appl. No.: 455,819

[22] Filed: Jan. 5, 1983

Related U.S. Application Data

[63] Continuation of Ser. No. 206,093, Nov. 12, 1980, abandoned.

[51] Int. Cl.[3] ..... B65D 59/04

[52] U.S. Cl. ..... 239/288.5; 220/85 F

[58] Field of Search ..... 239/288.5, 288.3, 288, 239/533.13; 220/254, 369, 85 F, 85 E, 85 H, DIG. 2

[56] References Cited

U.S. PATENT DOCUMENTS 4,146,058 3/1979 Bercovitz ..... 239/288.5

FOREIGN PATENT DOCUMENTS 2213113 3/1972 Fed. Rep. of Germany .... 220/85 F

*Primary Examiner*—James B. Marbert

*Attorney, Agent, or Firm*—Polster, Polster and Lucchesi

[57] ABSTRACT

A unitary, one-piece nozzle and guard unit secured to a tote bin of the type intended to be purged, as, for example, those used to contain hazardous chemicals. The nozzle-guard unit has a bottom wall, a boss extending from a surface of the bottom wall in one direction, a nozzle fitting extending from a surface of the bottom wall in the opposite direction, the boss, bottom wall and nozzle fitting having an open-ended passage extending completely through them, and a side wall spaced from, surrounding and extending beyond the nozzle fitting in the direction, from the bottom wall, of the nozzle fitting. The boss extends through a port in the bin and the unit is secured to the bin around a periphery of the unit contiguous the bin.

6 Claims, 3 Drawing Figures

NOZZLE AND GUARD UNIT

This is a continuation of application Ser. No. 206,093, filed Nov. 12, 1980 now abandoned.

BACKGROUND OF THE INVENTION

Sealed bins, as for example those used to contain hazardous chemicals such as phosphorus, are equipped with nozzles through which inert gas or other purging fluids (liquids or gases) are introduced. It has been customary to weld a ring around the nozzle to protect it from being damaged.

One of the objects of this invention is to provide a nozzle and guard unit that is simpler to install and inherently stronger, hence safer, than nozzle and guard arrangements known heretofore.

Other objects will become apparent to those skilled in the art in the light of the following description and accompanying drawing.

SUMMARY OF THE INVENTION

A unitary, one-piece nozzle and guard unit secured to a tote bin of the type requiring purging, such as those used to contain hazardous chemicals, has a bottom wall, a boss extending from a surface of the bottom wall in one direction, a nozzle fitting extending from a surface of the bottom wall in the opposite direction, the boss, bottom wall and nozzle fitting have an open-ended passage extending completely through them, and a side wall spaced from, surrounding and extending beyond the nozzle fitting in the direction, from the bottom wall, of the nozzle fitting. The boss extends through a port in the bin and the unit is secured to the bin around a periphery of the unit contiguous a surface of a wall of the bin. The unit preferably has a passage through the side wall at the level of the surface of the bottom wall from which the nozzle fitting projects, to provide for drainage. The side wall is circular in top plan and the surface of the bottom wall contiguous the boss is planar.

DESCRIPTION OF THE PREFERRED EMBODIMENT

Figure 1:
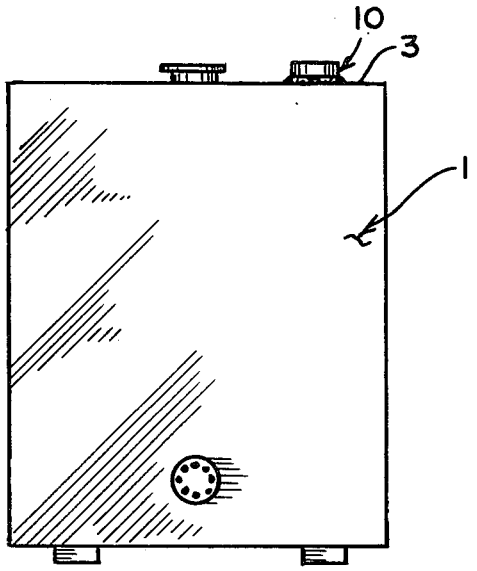
FIG. 1 is a view in side elevation of a tote bin equipped with a nozzle and guard unit of this invention.
Figure 2:
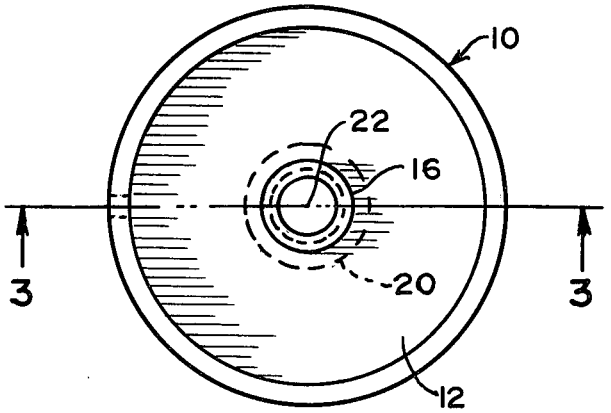
FIG. 2 is a top plan view of one embodiment of nozzle and guard unit of this invention.
Figure 3:
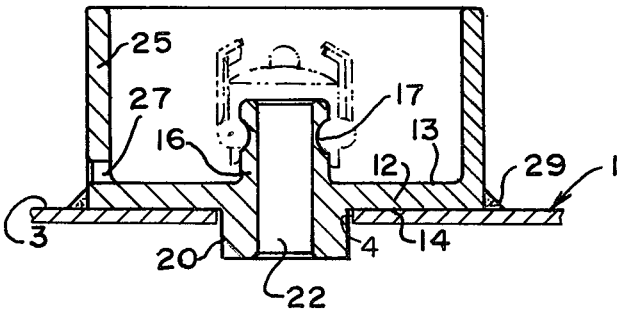
FIG. 3 is a sectional view taken along the line 3—3 of FIG. 2.

In the drawing reference numeral 1 indicates a container, in this embodiment an aluminum tote bin of the type used as a container for hazardous chemicals. The bin 1 has a flat surface 3, with a round opening 4 through it. A nozzle and guard unit 10 of this invention is secured to the flat surface 3 of the bin. The unit 10 is made in one piece, of the same material, preferably aluminum. The unit has a bottom wall 12 with an upper surface 13 and a lower surface 14. Projecting from the upper surface 13 is a nozzle or nozzle fitting 16, with the usual annular channel 17 adapted to receive a pressure fitting. A boss 20 projects from the lower surface 14 of the bottom wall 12. The boss 20 is cylindrical, and of a size to fit closely within the hole 4. A tapered passage 22, open at both ends, extends through the nozzle 16, bottom wall 12 and boss 20.

As shown in FIG. 1, the unit of this embodiment is circular in top plan. An annular side wall 25 is, in this embodiment coextensive with the perimeter of the bottom wall, and projects above the height of the nozzle 16 a distance a little more than twice the height of the nozzle. A drain hole 27 extends radially through the side wall 25 at the level of the upper surface 13.

Merely by way of illustration, the outside diameter of the unit can be 6-$\frac{3}{4}$", and its inside diameter, 6". The side wall and the bottom can be $\frac{3}{8}$" thick. The height of the unit from the surface 14 to the upper edge of the side wall 25 can be 3-$\frac{3}{8}$". The diameter of the hole 4 and the outside diameter of the boss 20 can be 2", the boss can be $\frac{3}{4}$" deep and the diameter of the tapered, cored passage 22 can go from $\frac{3}{4}$" at the top to 15/16" at its lower end. The nozzle can be 1-7/16" in outside diameter and 1-$\frac{5}{8}$" high.

The unit is welded to the surface 3 of the bin around its entire perimeter, as indicated at 29, the bottom surface 14 of the unit and the surface 3 being flat.

Because of the greater area of weld, and because of the seating of the boss 20 closely within the hole 4, the unit is more rugged and therefore less likely to be damaged than the separate nozzles and guards used heretofore.

Numerous variations in the construction of the nozzle and guard unit of this invention, within the scope of the appended claims, will occur to those skilled in the art in the light of the foregoing disclosure. Merely by way of example, and not of limitation, the dimensions of the device can be varied; a plurality of drain holes can be provided; the arris between the lower surface 14 and the outside surface of the side wall 25 can be chamfered or beveled to form a welding channel; other means of securing the unit to the bin, such as epoxy adhesive, may be employed; the shape of the unit in plan can be altered, as by making it square or oval, or the bottom wall can be extended beyond the outer surface of the side wall 25. The bin can be any vessel or container that requires provision for purging, and the term "tote bin" is used in the claims to encompass any and all such vessels and containers. These are merely illustrative.

I claim:

1. A unitary, one-piece nozzle and guard unit secured to a tote bin, comprising a bottom wall, a boss extending from a flat surface of said bottom wall in one direction, a nozzle fitting extending from a suface of said bottom wall in the opposite direction, said boss, bottom wall and nozzle fitting having an open-ended passage extending completely through them, and a side wall integral with the bottom wall and spaced outwardly from and surrounding said nozzle fitting, said boss extending through a hole in a flat surface of said bin and said unit being secured to said bin entirely around an outside periphery of said bottom wall contiguous said flat wall of said bin.

2. The unit of claim 1 in which a passage extends through said side wall at the level of the surface of the bottom wall from which the nozzle fitting projects.

3. The unit of claim 2 wherein the side wall is circular in top plan, and the surface of the bottom wall contiguous the boss is planar.

4. The unit of claim 1 wherein the boss fits closely within the hole in the bin.

5. The unit of claim 4 wherein the tote bin and unit are aluminum.

6. The unit of claim 1 wherein the means for securing the unit to the bin is a continuous weld.

* * * * *